US007223333B2

(12) United States Patent
Uzio et al.

(10) Patent No.: US 7,223,333 B2
(45) Date of Patent: May 29, 2007

(54) PROCESS FOR HYDRODESULPHURIZATION OF CUTS CONTAINING SULPHUR CONTAINING COMPOUNDS AND OLEFINS IN THE PRESENCE OF A CATALYST COMPRISING AN ELEMENT OF GROUP VIII AND TUNGSTEN

(75) Inventors: Denis Uzio, Marly le Roi (FR); Stephane Cremer, Saint Germain en Laye (FR); Carine Petit-Clair, Montesson (FR); Nathalie Marchal-George, Saint Genis Laval (FR); Christophe Bouchy, Rueil Malmaison (FR); Florent Picard, Saint Symphorien d'Ozon (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 516 days.

(21) Appl. No.: 10/449,725

(22) Filed: Jun. 2, 2003

(65) Prior Publication Data

US 2004/0007504 A1 Jan. 15, 2004

(30) Foreign Application Priority Data

Jun. 3, 2002 (FR) ..... 02 06816

(51) Int. Cl.
*C10G 45/04* (2006.01)

(52) U.S. Cl. ..... 208/216 R; 208/89; 208/213; 208/217; 208/238; 252/458; 252/465; 252/470

(58) Field of Classification Search ..... 208/89, 208/213, 216 R, 217, 238; 252/458, 465, 252/470

See application file for complete search history.

(56) References Cited

U.S. PATENT DOCUMENTS

| | | | | |
|---|---|---|---|---|
| 4,113,603 | A | 9/1978 | Bauer | |
| 4,334,982 | A | 6/1982 | Jacquin et al. | |
| 5,807,477 | A * | 9/1998 | Hearn et al. | 208/238 |
| 6,126,814 | A * | 10/2000 | Lapinski et al. | 208/217 |

* cited by examiner

*Primary Examiner*—Glenn Caldarola
*Assistant Examiner*—Prem C. Singh
(74) *Attorney, Agent, or Firm*—Millen, White, Zelano & Branigan, P.C.

(57) ABSTRACT

Conducting the hydrodesulphurization of gasoline cuts in the presence of a catalyst comprising at least one support, at least one element of group VIII and tungsten, in which the atomic ratio (element of group VIII)/(element of group VIII+tungsten) is greater than 0.15 and less than 0.50, preferably 0.35–0.40 inclusive.

17 Claims, No Drawings

PROCESS FOR HYDRODESULPHURIZATION OF CUTS CONTAINING SULPHUR CONTAINING COMPOUNDS AND OLEFINS IN THE PRESENCE OF A CATALYST COMPRISING AN ELEMENT OF GROUP VIII AND TUNGSTEN

This application relates to Applicants' concurrently filed application entitled "Process For The Hydrodesulphurizing Cuts Containing Sulphur-Containing Compounds And Olefins In The Presence Of A Supported Catalyst Comprising Group VIII And VIB Elements".

The present invention relates to a catalyst comprising at least one support, at least one element of group VIII and tungsten which allows hydrodesulphurization of hydrocarbon batches, preferably of the type of gasolines from catalytic cracking (FCC, fluid catalytic cracking or catalytic cracking in a fluidized bed). The invention more particularly relates to a process for the hydrodesulphurization of gasoline cuts in the presence of a catalyst comprising at least one support, at least one element of group VIII and tungsten, in which the atomic ratio (element of group VIII)/(element of group VIII+tungsten) is greater than 0.15 and less than 0.50.

PRIOR ART

Gasoline cuts, and more particularly the gasolines produced by FCC, contain about 20 to 40% of olefinic compounds, 30 to 60% of aromatics and 20 to 50% of saturated compounds of the paraffin or naphthene type. Among the olefinic compounds, branched olefins are predominant compared with linear and cyclic olefins. These gasolines also contain traces of highly unsaturated compounds of the diolefin type, which are capable of deactivating the catalysts by the formation of gums. The patent EP 685 552 B1 thus proposes selective dehydrogenation of the diolefins, that is to say without conversion of the olefins, before carrying out the hydrotreatment to remove the sulphur. The content of sulphur compounds of these gasolines varies widely as a function of the type of gasoline (vapour-phase cracker, catalytic cracking, coke formation etc.) or, in the case of catalytic cracking, the severity applied to the process. It can fluctuate between 200 and 5,000 ppm of S, preferably between 500 and 2,000 ppm, based on the weight of the batch. The families of thiophene and benzothiophene compounds are predominant, mercaptans being present only at very low levels, generally of between 10 and 100 ppm. FCC gasolines also contain nitrogen compounds in proportions which generally do not exceed 100 ppm.

The production of reformed gasolines in accordance with new environmental standards requires the least possible reduction in their olefin concentration in order to preserve a high octane rating, but a significant reduction in their sulphur content. Environmental standards in force and of the future thus compel refiners to reduce the sulphur content in the gasolines to values of less than or at most equal to 50 ppm in 2003 and 10 ppm beyond 2005. These standards relate to the total sulphur content, and also the nature of sulphurized compounds, such as mercaptans. Gasolines from catalytic cracking, which may represent 30 to 50% of the gasoline pool, have high contents of olefins and sulphur. The sulphur present in reformed gasolines is attributable to almost 90% to FCC gasoline. The desulphurization (hydrodesulphurization) of gasolines and chiefly of FCC gasolines is therefore of obvious importance in complying with specifications. Hydrotreatment (or hydrodesulphurization) of gasolines from catalytic cracking, when carried out under the conventional conditions known to the person skilled in the art, enables the sulphur content of the cut to be decreased. However, this process has the major disadvantage of causing a very significant drop in the octane rating of the cut because of saturation of all the olefins in the course of the hydrotreatment. Processes which enable intensive desulphurization of FCC gasolines while maintaining the octane rating at a high level have therefore been proposed.

The patent U.S. Pat. No. 5,318,690 thus proposes a process which consists of fractionating the gasoline, sweetening the light fraction and hydrotreating the heavy fraction over a conventional catalyst and then treating it on a ZSM5 zeolite to regain approximately the initial octane rating.

The patent application WO 01/40409 claims treatment of an FCC gasoline under conditions of high temperature, low pressure and high hydrogen/batch ratio. Under these particular conditions the recombination reactions which lead to the formation of mercaptans, involving the $H_2S$ formed by the desulphurization and the olefins, are minimized.

Finally, the patent U.S. Pat. No. 5,968,346 proposes an arrangement which enables very low residual sulphur contents to be achieved by a process in several stages: hydrodesulphurization over a first catalyst, separation of liquid and gaseous fractions, and a second hydrotreatment over a second catalyst. The liquid/gas separation enables the $H_2S$ formed in the first reactor to be removed, in order to arrive at a better compromise between hydrodesulphurization and octane loss.

Achievement of the required selectivity of the reaction (ratio between hydrodesulphurization and hydrogenation of olefins) can thus be in part due to the choice of the process, but in all cases the use of an intrinsically selective catalytic system is very often a key factor.

In general, the catalysts used for this type of application are catalysts of the sulphur type containing an element of group VIB (Cr, Mo, W) and an element of group VIII (Fe, Ru, Os, Co, Rh, Ir, Pd, Ni, Pt). The patent U.S. Pat. No. 5,985,136 thus claims that a catalyst having a surface concentration of between $0.5–10^{-4}$ and $3–10^{-4}$ g $MoO_3/m^2$ enables high hydrodesulphurization selectivities to be achieved (93% hydrodesulphurization (HDS) against 33% hydrogenation of olefins (HDO)). Furthermore, according to the patents U.S. Pat. No. 4,140,628 and U.S. Pat. No. 4,774,220 it may be advantageous to add a doping agent (alkali metal, alkaline earth metal) to the conventional sulphur phase (CoMoS) for the purpose of limiting the hydrogenation of olefins.

Another route which enable the intrinsic selectivity of the catalysts to be improved is to make use of the presence of carbon-containing deposits on the surface of the catalyst. The patent U.S. Pat. No. 4,149,965 thus proposes pretreatment of a conventional catalyst for hydrotreatment of naphtha to partly deactivate it before its use for the hydrotreatment of gasolines. In addition, the patent application EP 0 745 660 A1 states that pretreatment of a catalyst in order to deposit between 3 and 10% by weight of coke improves catalytic outputs. In this case it is specified that the C/H ratio must not be greater than 0.7.

SUMMARY OF THE INVENTION

In the present invention a catalyst has been found which can be used in a process for the hydrodesulphurization of gasoline and enables the contents of total sulphur and of mercaptans in hydrocarbon cuts, and preferably FCC gasoline cuts, to be decreased without a significant loss of gasoline and with minimization of the reduction in the octane rating.

More precisely, the invention relates to a process for the hydrodesulphurization of gasoline cuts in the presence of a catalyst comprising at least one support, at least one element of group VIII and tungsten, in which the atomic ratio (element of group VIII)/(element of group VIII+tungsten) is greater than 0.15 and less than 0.50, preferably greater than 0.20 and less than 0.50.

DETAILED DESCRIPTION OF THE INVENTION

The feed to be hydrotreated (or hydrodesulphurized) by means of the process according to the invention is in general a gasoline cut containing sulphur; such as, for example, a cut produced by a plant for coke formation (coking according to Anglo-Saxon terminology), viscoreduction (visbreaking according to Anglo-Saxon terminology), vapour-phase cracking (steam cracking according to Anglo-Saxon terminology) or catalytic cracking (FCC, fluid catalytic cracking according to Anglo-Saxon terminology). The said feed is preferably a gasoline cut produced by a catalytic cracking plant, the boiling points range of which typically extends from the boiling points of hydrocarbons having 5 carbon atoms up to about 250° C. This gasoline can possibly also be composed of a significant fraction of gasolines originating from other production processes, such as atmospheric distillation (gasoline produced from direct distillation (or straight run gasoline according to Anglo-Saxon terminology) or conversion processes (coke formation or vapour-phase cracking).

The hydrodesulphurization catalysts according to the invention are catalysts comprising tungsten and at least one element of group VIII on a suitable support. The element or elements of group VIII are preferably chosen from nickel and/or cobalt. The catalyst support is usually a porous solid chosen from the group consisting of: aluminas, silica, alumosilicas or the oxides of titanium and magnesium, used by themselves or as a mixture with alumina or alumosilica. It is preferably chosen from the group consisting of: silica, the family of transition aluminas and alumosilicas, and very preferably the support is essentially made up of at least one transition alumina, that is to say it comprises at least 51% by weight, preferably at least 60% by weight, very preferably at least 80% by weight, and even at least 90% by weight of transition alumina. It may possibly also consist solely of a transition alumina.

The specific surface area of the support according to the invention is in general less than about 200 $m^2/g$, preferably less than 170 $m^2/g$, and more preferably less than 150 $m^2/g$, and even less than 135 m 2/g. The support can be prepared using any precursor, any preparation method and any shaping tool known to the person skilled in the art.

The catalyst according to the invention can be prepared by means of any technique known to the person skilled in the art, and in particular by impregnation of elements of group VIII and tungsten on to the support selected. This impregnation can be carried out, for example, by the method known to the person skilled in the art under the terminology dry impregnation, in which just the desired amount of elements is introduced in the form of salts which are soluble in the solvent chosen, for example demineralized water, such that the porosity of the support is filled as exactly as possible. The support filled by the solution in this way is preferably dried.

After introduction of elements of group VIII and tungsten, and optionally shaping of the catalyst, this is subjected to an activation treatment. The aim of this treatment is in general to transform the molecular precursors of the elements into the oxide phase. In this case it is an oxidizing treatment, but direct reduction can also be carried out. In the case of an oxidizing treatment, also called calcination, this is in general carried out under air or under dilute oxygen and the treatment temperature is in general between 200° C. and 550° C., preferably between 300° C. and 500° C. In the case of a reducing treatment this is in general carried out under pure or preferably dilute hydrogen and the treatment temperature is in general between 200° C. and 600° C., preferably between 300° C. and 500° C.

Salts of elements of group VIII and of tungsten which can be used in the process according to the invention are, for example, cobalt nitrate, aluminium nitrate or ammonium metatungstate. Any other salt known to the person skilled in the art which has a sufficient solubility and can be decomposed during the activation treatment can also be used.

The catalyst is usually used in a sulphurized form obtained after heat treatment in contact with a sulphur-containing organic compound which can be decomposed and generates $H_2S$, or directly in contact with a gaseous stream of $H_2S$ diluted in $H_2$. This stage can be carried out in situ or ex situ (inside or outside the reactor) of the hydrodesulphurization reactor at temperatures of between 200 and 600° C., and more preferably between 300 and 500° C.

On the other hand, the use of a support of high specific surface area sometimes presents problems in the case of a highly olefinic batch. In fact, since the acidity of the surface increases with the specific surface area of supports, acid-catalysed reactions will be favoured for supports of high specific surface area. Polymerization or coking reactions which lead to the formation of gums or coke and finally premature deactivation of the catalyst will thus be more significant in this case on supports of high specific surface area. A better stability of the catalysts will therefore be obtained for supports of low specific surface area. In this case the specific surface area of the support preferably must not exceed about 300 $m^2/g$, and more preferably must be lower than 280 $m^2/g$, and even lower than 150 $m^2/g$.

The content of elements of group VIII in the catalyst according to the invention is preferably between 1% by weight and 20% by weight of oxides of elements of group VIII, preferably between 2% by weight and 8% by weight of oxides of elements of group VIII. Preferably, the element of group VIII is cobalt or nickel or a mixture of these two elements, and more preferably the element of group VIII is solely cobalt and/or nickel.

The content of tungsten is preferably between 1.5% by weight and 60% by weight of tungsten oxide, more preferably between 3% by weight and 50% by weight of tungsten oxide. The atomic ratio (element of group VIII)/(element of group VIII+tungsten) is greater than 0.15 and less than 0.50, preferably greater than 0.20 and less than 0.50, more preferably greater than 0.20 and less than or equal to 0.45, and even greater than 0.30 and less than or equal to 0.45. Very preferably, the said atomic ratio is greater than or equal to 0.35 and less than or equal to 0.40.

The catalyst according to the invention can be used in any process known to the person skilled in the art which enables hydrocarbon cuts of the type of gasolines from catalytic cracking (FCC) to be desulphurized, for example while maintaining the octane rating at high values. It can be used in any type of reactor operated as a fixed bed or moving bed or bubbling bed, but it is preferably used in a reactor operated as a fixed bed.

By way of indication, the operating conditions which enable selective hydrodesulphurization of gasolines from catalytic cracking are a temperature of between about 200° C. and about 400° C., preferably between about 250° C. and about 350° C., a total pressure of between 1 MPa and 3 MPa, and more preferably between about 1 MPa and about 2.5 MPa, with a ratio of the volume of hydrogen per volume of hydrocarbon batch of between about 100 and about 600 liters per liter, and more preferably between about 200 and about 400 liters per liter. In general, the hourly space velocities (HSV) are between 1 and 15 $h^{-1}$. The HSV is defined as the ratio of the volume flow rate of the liquid hydrocarbon batch to the volume of catalyst loaded in the reactor.

EXAMPLES

Preparation of the Catalysts.

Catalyst A (Not According to the Invention):

Catalyst A, based on molybdenum, is prepared by addition of cobalt and molybdenum to an alumina support in "bead" form. These two elements are introduced simultaneously by dry impregnation of the support. The cobalt salt used is cobalt nitrate, the molybdenum precursor being ammonium heptamolybdate tetrahydrate. The impregnation solution is prepared by dissolving ammonium heptamolybdate in water with addition of hydrogen peroxide ($H_2O_2/MoO_3$=0.5) in order to facilitate dissolving of the molybdenum, the dissolving of Co presenting no problem. The impregnation with the solution is then carried out dropwise on the alumina. After dry impregnation the beads are left to mature in an atmosphere saturated with water for 12 h and are then dried overnight at 120° C. and finally calcined at 500° C. (gradient=5° C./min) for 2 hours under dry air (1 l/h/g of catalyst). The characteristics of catalyst A are provided in table 1 below:

TABLE 1

Characteristics of catalyst A (not according to the invention).

| Support | $S_{BET}$ of the support $m^2/g$ | Surface density CoO $mol/m^2$ | Surface density $MoO_3$ $mol/m^2$ | Co/(Co + Mo) |
|---|---|---|---|---|
| SCM139XL | 135 | $3.56 \cdot 10^{-6}$ | $6.40 \cdot 10^{-6}$ | 0.36 |

Catalyst B (Not According to the Invention):

Catalyst B, based on molybdenum, is prepared in the same manner as catalyst A, with an alumina of high specific surface area to reduce the surface density of the molybdenum oxide. The characteristics of catalyst B are provided in table 2 below.

TABLE 2

Characteristics of catalyst B (not according to the invention).

| Support | $S_{BET}$ of the support $m^2/g$ | Surface density CoO $mol/m^2$ | Surface density $MoO_3$ $mol/m^2$ | Co/(Co + Mo) |
|---|---|---|---|---|
| GFSA | 273 | $3.14 \cdot 10^{-6}$ | $4.60 \cdot 10^{-6}$ | 0.40 |

Catalyst C (According to the invention):

Catalyst C, based tungsten, is prepared by addition of cobalt and tungsten to an alumina support in bead form. The two elements are introduced simultaneously by dry impregnation of the support. The cobalt salt used is Co nitrate, the tungsten precursor being ammonium metatungstate. The impregnation with the solution is carried out dropwise on the alumina. After dry impregnation the beads are left to mature in an atmosphere saturated with water for 12 h and are then dried overnight at 120° C. and finally calcined at 500° C. (gradient=5° C./min) for 2 hours under dry air (1 l/h/g of catalyst). The characteristics of catalyst C are provided in table 3 below:

TABLE 3

Characteristics of catalyst C (according to the invention).

| Support | $S_{BET}$ of the support $m^2/g$ | Surface density CoO $mol/m^2$ | Surface density $WO_3$ $mol/m^2$ | Co/(Co + W) |
|---|---|---|---|---|
| SCM139XL | 135 | $3.88 \cdot 10^{-6}$ | $6.21 \cdot 10^{-6}$ | 0.38 |

Catalyst D (According to the Invention):

Catalyst D, based on tungsten, is prepared in the same manner as catalyst C, with an alumina of high specific surface area to reduce the surface density of the tungsten oxide. The characteristics of catalyst D are provided in table 4 below.

TABLE 4

Characteristics of catalyst D (according to the invention).

| Support | $S_{BET}$ of the support $m^2/g$ | Surface density CoO $mol/m^2$ | Surface density $WO_3$ $mol/m^2$ | Co/(Co + W) |
|---|---|---|---|---|
| GFSA | 273 | $3.14 \cdot 10^{-6}$ | $4.66 \cdot 10^{-6}$ | 0.40 |

Catalyst E (Not According to the Invention):

Catalyst E is prepared in the same manner as catalyst C. The surface density of the tungsten oxide is identical to that of catalyst C (according to the invention), while that of the cobalt is reduced. The characteristics of catalyst E are provided in the table below.

TABLE 5

Characteristics of catalyst E (not according to the invention).

| Support | $S_{BET}$ of the support $m^2/g$ | Surface density CoO $mol/m^2$ | Surface density $WO_3$ $mol/m^2$ | Co/(Co + W) |
|---|---|---|---|---|
| SCM139XL | 135 | $6.90 \cdot 10^{-7}$ | $6.21 \cdot 10^{-6}$ | 0.10 |

Catalyst F (According to the Invention):

Catalyst F is prepared in the same manner as catalyst C. The surface density of the tungsten oxide is identical to that of catalyst C (according to the invention), while that of the cobalt is reduced. The characteristics of catalyst F are provided in the table below.

TABLE 6

Characteristics of catalyst F (according to the invention).

| Support | $S_{BET}$ of the support $m^2/g$ | Surface density CoO mol/$m^2$ | Surface density $WO_3$ mol/$m^2$ | Co/ (Co + W) |
|---|---|---|---|---|
| SCM139XL | 135 | $1.27 \cdot 10^{-6}$ | $6.21 \cdot 10^{-6}$ | 0.17 |

Catalyst G (According to the Invention):

Catalyst G is prepared in the same manner as catalyst C. The surface density of the tungsten oxide is identical to that of catalyst C (according to the invention), while that of the cobalt is reduced. The characteristics of catalyst G are provided in the table below.

TABLE 7

Characteristics of catalyst G (according to the invention).

| Support | $S_{BET}$ of the support $m^2/g$ | Surface density CoO mol/$m^2$ | Surface density $WO_3$ mol/$m^2$ | Co/ (Co + W) |
|---|---|---|---|---|
| SCM139XL | 135 | $1.75 \cdot 10^{-6}$ | $6.21 \cdot 10^{-6}$ | 0.22 |

Catalyst H (According to the Invention):

Catalyst H is prepared in the same manner as catalyst C. The surface density of the tungsten oxide is identical to that of catalyst C (according to the invention), while that of the cobalt is increased. The characteristics of catalyst H are provided in the table below.

TABLE 8

Characteristics of catalyst H (according to the invention).

| Support | $S_{BET}$ of the support $m^2/g$ | Surface density CoO mol/$m^2$ | Surface density $WO_3$ mol/$m^2$ | Co/ (Co + W) |
|---|---|---|---|---|
| SCM139XL | 135 | $5.08 \cdot 10^{-6}$ | $6.21 \cdot 10^{-6}$ | 0.45 |

Catalyst I (Not According to the Invention):

Catalyst I is prepared in the same manner as catalyst C. The surface density of the tungsten oxide is identical to that of catalyst C (according to the invention), while that of the cobalt is increased. The characteristics of catalyst I are provided in the table below.

TABLE 8

Characteristics of catalyst I (not according to the invention).

| Support | $S_{BET}$ of the support $m^2/g$ | Surface density CoO mol/$m^2$ | Surface density $WO_3$ mol/$m^2$ | Co/ (Co + W) |
|---|---|---|---|---|
| SCM139XL | 135 | $7.00 \cdot 10^{-6}$ | $6.21 \cdot 10^{-6}$ | 0.53 |

Example 1

According to the Invention

The outputs of the catalysts CoMo and CoW were compared for close surface densities of Mo and W, and for comparable atomic ratios Co/Co+(Mo or W).

Catalysts A, B, C and D described above were tested in a selective desulphurization reaction on a model batch of the FCC gasoline type. The test is carried out in a Grignard reactor (batch) at 200° C. under a hydrogen pressure of 3.5 MPa, which is kept constant. The model batch comprises 1,000 ppm 3-methylthiophene and 10% by weight of 2,3-dimethylbut-2-ene in n-heptane. The volume of the solution is 210 cc in the cold, the weight of catalyst tested being 4 grams (before sulphurization). Before the test the catalyst is first sulphurized in a sulphurization bed under a mixture of $H_2S/H_2$ (4 l/h, 15% by volume of $H_2S$) at 500° C. for two hours (gradient of 5° C./min) and then reduced under pure $H_2$ at 200° C. for two hours. The catalyst is then transferred into the Grignard reactor in the absence of air.

The tests are continued until the HDS levels (conversion of 3-methylthiophene) are close to 90%.

The rate constant (standardized per g of catalyst) is calculated taking into account an order of 1 for the desulphurization reaction ($k_{HDS}$) and an order of 0 for the hydrogenation reaction ($k_{HDO}$). The selectivity of a catalyst is defined as the ratio of its rate constants, $k_{HDS}/k_{HDO}$.

The relative rate constants, with respect to catalyst A, of catalysts A, B, C and D and their selectivity are shown in table 9 below. Surprisingly, the catalysts based on tungsten are more selective, at the same surface density, than the catalysts based on molybdenum.

TABLE 9

Catalytic properties of catalysts A, B, C and D.

| Catalyst | k HDS | k HDO | k HDS/k HDO | Co/Co + (W or Mo) | Surface density $MoO_3$ or $WO_3$ mol/$m^2$ |
|---|---|---|---|---|---|
| A (Mo) | 1.00 | 1.62 | 0.62 | 0.36 | $6.40 \cdot 10^{-6}$ |
| B (Mo) | 1.26 | 2.29 | 0.55 | 0.40 | $4.60 \cdot 10^{-6}$ |
| C (W) | 0.75 | 1.05 | 0.71 | 0.38 | $6.21 \cdot 10^{-6}$ |
| D (W) | 1.07 | 1.67 | 0.64 | 0.40 | $4.66 \cdot 10^{-6}$ |

Example 2

According to the Invention

Catalysts C, E, F, G, H, I are tested on the model batch following the same protocol as described in example 1. The relative rate constants of the catalysts and their selectivity are shown in table 10 below.

TABLE 10

Catalytic properties of catalysts C, E, F, G, H, I.

| Catalyst | k HDS | k HDO | k HDS/k HDO | Co/ (Co + W) | Surface density $WO_3$ mol/$m^2$ |
|---|---|---|---|---|---|
| C | 0.75 | 1.05 | 0.71 | 0.38 | $6.21 \cdot 10^{-6}$ |
| E | 0.39 | 0.80 | 0.49 | 0.10 | $6.21 \cdot 10^{-6}$ |
| F | 0.53 | 0.88 | 0.60 | 0.17 | $6.21 \cdot 10^{-6}$ |
| G | 0.60 | 0.91 | 0.66 | 0.22 | $6.21 \cdot 10^{-6}$ |
| H | 0.65 | 0.95 | 0.68 | 0.45 | $6.21 \cdot 10^{-6}$ |
| I | 0.50 | 0.93 | 0.54 | 0.53 | $6.21 \cdot 10^{-6}$ |

The selectivity of catalyst E is greatly reduced for a Co/(Co+W) ratio of 0.10. In the same manner, the selectivity of catalyst I, with too high a Co/(Co+W) ratio (0.53), is reduced.

The preceding examples can be repeated with similar success by substituting the generically or specifically described reactants and/or operating conditions of this invention for those used in the preceding examples.

The entire disclosures of all applications, patents and publications, cited herein and of corresponding French application No. 02/06.812, filed Jun. 3, 2002 is incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process comprising the hydrodesulphurizing a gasoline cut in the presence of a catalyst comprising at least one support, at least one element of group VIII and tungsten, in which the atomic ratio (element of group VIII)/(element of group VIII+tungsten) is greater than or equal to 0.35 and less than or equal to 0.40.

2. A hydrodesulphurization process according to claim 1, wherein the content of elements of group VIII of the catalyst is between 1 and 10% by weight of oxides of elements of group VIII and the content of tungsten is between 1.5% by weight and 60% by weight of tungsten oxide.

3. A process according to claim 1, wherein the catalyst comprises at least one element of group VIII chosen from nickel and cobalt.

4. A process according to claim 1, wherein the catalyst support is a porous solid chosen from the group consisting of: aluminas, silica, alumosilicas or oxides of titanium or magnesium, used by themselves or as a mixture with alumina or alumosilica.

5. A process according to claim 1, wherein the catalyst support comprises at least 90% by weight of transition alumina.

6. A process according to claim 1, wherein the gasoline cut to be hydrodesulphurized is produced from a plant for coke formation, viscoreduction, vapor-phase cracking or catalytic cracking.

7. A process according to claim 1, wherein the gasoline to be hydrodesulphurized is a product from a catalytic cracking plant, of which the boiling points range extends from about the boiling points of hydrocarbons having 5 carbon atoms up to about 250° C.

8. A process according to claim 7, wherein the operating conditions of the hydrodesulphurization comprise: a temperature of between about 200 and about 400° C., a total pressure of between 1 MPa and 3 MPa, and a ratio of volume of rogen per volume of hydrocarbon batch of between about 100 and about 600 liters per liter.

9. A process according to claim 6, wherein the gasoline cut to be hydrodesulphurized is a highly olefinic gasoline cut and the specific surface area of the catalyst does not exceed 300 $m^2/g$.

10. A process according to claim 1, wherein the catalyst comprises cobalt.

11. A process according to claim 2, wherein the catalyst comprises at least one element of group VIII chosen from nickel and cobalt.

12. A process according to claim 3, wherein the catalyst support comprises at least 90% by weight of transition alumina.

13. A process according to claim 10, wherein the catalyst support comprises at least 90% by weight of transition alumina.

14. A process according to claim 11, wherein the catalyst support comprises at least 90% by weight of transition alumina.

15. A hydrodesulphurization process according to claim 1, wherein the atomic ratio (element of group VIII)/(element of group VIII+tungsten) is about 0.36 to 0.38.

16. A process according to claim 15, wherein the element of group VIII is cobalt.

17. A process according to claim 15, wherein the tungsten is present in the form of $WO_3$ on the surface of the support, and wherein the surface density of $WO_3$ is about $6.21\times10_{-6}$ $mol/m^2$.

* * * * *

UNITED STATES PATENT AND TRADEMARK OFFICE

CERTIFICATE OF CORRECTION

PATENT NO. : 7,223,333 B2
APPLICATION NO. : 10/449725
DATED : May 29, 2007
INVENTOR(S) : Denis Uzio It is certified that error appears in the above-identified patent and that said Letters Patent is hereby corrected as shown below:

Column 10, line 37 claim 17, reads "$6.21x10_{-6}$" should read -- $6.21x10^{-6}$ --

Signed and Sealed this

Eighteenth Day of March, 2008

JON W. DUDAS
*Director of the United States Patent and Trademark Office*